US006816072B2

(12) United States Patent
Zoratti

(10) Patent No.: US 6,816,072 B2
(45) Date of Patent: Nov. 9, 2004

(54) FIRE HYDRANT ANTI-TAMPER DEVICE

(76) Inventor: Michael Zoratti, 39789 Duluth, Harrison Twp., MI (US) 48045-1509

( * ) Notice: Subject to any disclaimer, the term of this patent is extended or adjusted under 35 U.S.C. 154(b) by 0 days.

(21) Appl. No.: 10/310,231

(22) Filed: Dec. 5, 2002

(65) Prior Publication Data

US 2003/0107485 A1 Jun. 12, 2003

Related U.S. Application Data

(60) Provisional application No. 60/340,754, filed on Dec. 7, 2001.

(51) Int. Cl.[7] ..... G08B 21/00

(52) U.S. Cl. ..... 340/540; 340/506; 340/615; 137/272; 137/296; 137/377; 169/23; 220/724; 248/551; 285/901

(58) Field of Search ..... 340/540, 506, 340/691, 693, 603, 618, 615; 73/40.5 R, 37, 39, 592, 597; 137/305, 312, 377, 5, 296, 294, 272, 382; 169/16, 23, 51, 54; 220/724; 248/551; 70/164; 285/901

(56) References Cited

U.S. PATENT DOCUMENTS

| | | | | | |
|---|---|---|---|---|---|
| 4,609,994 | A | * | 9/1986 | Bassim et al. | 702/39 |
| 5,473,322 | A | | 12/1995 | Carney | |
| 5,803,110 | A | * | 9/1998 | Segal | 137/68.14 |
| 5,864,287 | A | * | 1/1999 | Evans, Jr. et al. | 340/506 |
| 5,974,862 | A | * | 11/1999 | Lander et al. | 73/40.5 A |
| 6,101,451 | A | | 8/2000 | Smith et al. | |
| 6,232,886 | B1 | | 5/2001 | Morand | |
| 6,561,032 | B1 | * | 5/2003 | Hunaidi | 73/597 |

* cited by examiner

*Primary Examiner*—Davetta W. Goins
(74) *Attorney, Agent, or Firm*—Young & Basile, PC

(57) ABSTRACT

A detection and signaling apparatus is mountable in a fire hydrant to detect a parameter, such as unauthorized movement of a discharge nozzle cap relative to the fire hydrant. A housing carrying a sensor, such as a motion detector, is mounted inside of the cap. The sensor has an output connected to a transmitter. Movement of the cap relative to the fire hydrant activates the motion detector which generates an output signal causing the transmitter to remotely transmit a tamper detection signal and, also, a fire hydrant location identification code. A pressure sensor can also be coupled to the transmitter to sense water supply main pressure and water flow through the fire hydrant.

40 Claims, 7 Drawing Sheets

FIRE HYDRANT ANTI-TAMPER DEVICE

CROSS REFERENCE TO CO-PENDING APPLICATION

This application claims the benefit of the priority filing date of U.S. Provisional Patent Application Ser. No. 60/340,754, filed Dec. 7, 2001, the entire contents of which are incorporated herein by reference.

BACKGROUND

Modern fire hydrants typically include a bonnet mounted on a standpipe extending out of the ground and connected at a lower end to a fitting and a coupler which is, in turn, connected to the water distribution conveyance piping, also called a water supply main. A valve extends down through the bonnet and standpipe to control the flow of water through the fire hydrant from the water supply main. A valve operating nut extends outward from the bonnet to provide for selective movement of the valve.

One or more discharge nozzle caps are threadingly mounted on sleeves extending outward from the bonnet. Removal of the discharge nozzle caps allows a threaded connection between the sleeve and a fire hose for dispensing water from the fire hydrant when the operating nut is rotated to move the valve to an open position allowing water flow through the hydrant to the fire hose.

Tampering is a constant problem for municipal utilities. Frequently, a discharge nozzle cap is removed from the bonnet and the valve moved to the open position by a non-utility person or fireman to allow water flow from the fire hydrant. While this can be a harmless prank, an open flowing fire hydrant causes a significant decrease in the pressure of the water supply main. This results in an inability to fight fires within the entire section or loop part of the supply main grid since all nearby fire hydrants on that portion of the grid are rendered useless.

A more serious problem is the easy access to the water supply through the fire hydrant for the introduction of harmful elements, such as bacteria, virus, poison etc. It is relatively easy to remove the discharge nozzle cap, introduce a harmful element into the empty interior of the fire hydrant, re-thread the discharge nozzle cap onto the sleeve and then operate the spindle to move the valve to the open position. The flow of water through the water main will then draw the introduced elements into the water supply.

Various tamper resistant devices have been constructed to make it more difficult to unauthorizedly open the fire hydrant and the discharge of water therethrough. Such devices are typically mechanical in nature and fit over the valve operating nut or one or more of the discharge nozzle caps to prevent unauthorized movement of the spindle or cap.

However, such tamper resistant devices have met with limited success. Prior tamper resistant devices have sufficed in their intended design as a deterrent for children whom open fire hydrants to cool off and the average water thief, such as, contractors, pool companies, lawn spraying companies, etc.

However, the prior tamper resistant devices are inadequate for security purposes in the case of the deliberate introduction of contamination or toxic materials into the water supply through a fire hydrant. The wrenches, special tools and mechanical locks or actuators used in such tamper resistant devices are easily defeated by means of ingenious homemade tools, large pipe wrenches, or, in many cases, the actual fire hydrant opening tools acquired from water departments, fire departments, etc., and circulated through a public works department to contractors, plumbers, etc. Further, the only way to determine if a fire hydrant has been tampered with is to visually inspect the hydrant or the tamper resistant device to see if it has been damaged, opened, etc. An individual intent on the deliberate introduction of contaminates into a water system can undetectedly remove a discharge nozzle cap, introduce the contaminates into the hydrant, reinstall the cap, and then open the valve operating nut to cause the contaminates to be drawn into the water supply main. Since there is no discharge of water from the hydrant or resulting pressure loss in the water supply section or grid, this activity is undetectable.

What is needed is an apparatus which detects a fire hydrant operating parameter, such as unauthorized movement of the fire hydrant discharge nozzle cap, during unauthorized removal or attempted removal of the discharge nozzle cap, and then transmits a signal indicating the location of the fire hydrant to a central site, such as a police station, municipal water utility office, etc.

Tamper detection and signaling devices have been constructed for electrical power utilities to detect unauthorized movement of an electric watthour meter from a meter socket. Typically, a tilt switch is mounted in the socket to detect movement of the meter after the meter has been sealingly locked to the socket. However, heretofore there has been no application of tamper detection coupled with automatic remote signaling of a detected tamper event for a fire hydrant.

SUMMARY

The present invention is a fire hydrant accessory which provides remote signaling to a central location, such as a water treatment plant system control and data acquisition control room, of a sensed parameter at a fire hydrant location. The sensed parameter can be any one or more of detection of tampering of fire hydrant, water pressure, temperature of the water flowing through the hydrant, temperature of the ambient air surrounding the hydrant, etc. Uniquely, the remote signal from a fire hydrant carries a discrete fire hydrant identification or location indicator which can be correlated to the specific location or street address dispatch of emergency response equipment and personnel, to the fire hydrant for repair, etc.

In one aspect of the invention, the apparatus is a tamper detection apparatus which includes a discharge nozzle cap movement detector mounted on a fire hydrant discharge nozzle cap. The discharge nozzle cap movement detector generates an output upon detecting movement of the discharge nozzle cap relative to the fire hydrant. A transmitter means coupled to the discharge nozzle cap, is responsive to the output of the discharge nozzle cap movement detector for remotely transmitting a tamper detection signal. A control means is mounted in a housing sealingly coupled to the discharge nozzle cap and disposed interiorly within the hydrant. The housing carries the motion detector switch as well as other sensors, such as a pressure sensor or transducer, temperature sensors, condensation and/or moisture sensors, etc. The housing also houses a control means which stores a unique fire hydrant location identification number or code. The transmitter means transmits the identification number or code when transmitting the tamper signal to identify the location of the hydrant. In another aspect of the invention, a fire hydrant includes a housing fluidically coupled to a water supply conduit. A discharge outlet is carried in the housing. A discharge nozzle cap is threadlingly mountable over the discharge outlet to removably open or close the discharge outlet. A discharge nozzle cap movement detector is coupled to the fire hydrant discharge nozzle cap to detect movement of the discharge nozzle cap relative to the fire hydrant. A transmitter is coupled to the discharge nozzle cap and is responsive to the output of the discharge nozzle cap movement detector, for remotely transmitting a tamper detection signal.

In another aspect, the invention is a method for detecting tampering with a fire hydrant. The method comprises the steps of mounting a discharge nozzle cap movement detector in the discharge nozzle cap to detect movement of the discharge nozzle cap relative to the housing and coupling a signal frequency transmitter to the detector so that the transmitter, in response to an output from the motion detector, remotely transmits a tamper signal.

In yet another aspect, the present invention is a method of monitoring a parameter of a fire hydrant. This method comprises the steps of mounting a parameter sensor in the discharge nozzle cap to detect an operating parameter of the interior of the fire hydrant when the discharge nozzle cap is mounted on the discharge outlet of the fire hydrant and coupling a signal frequency transmitter to the sensor so that the transmitter, in response to an output from the sensor, remotely transmits a signal containing data corresponding to the sensed operating parameter as well as the fire hydrant location.

In yet another aspect, the present invention is a method of detecting an operating parameter of a fire hydrant. The method comprises the steps of storing a unique fire hydrant identification in a housing mountable within the discharge nozzle cap, storing the geographical coordinates of the fire hydrant with the unique fire hydrant identification, and providing a transmitter in the housing for transmitting a signal from the housing and fire hydrant to a remote central processor, the signal containing at least the identification of the fire hydrant from which the signal emanated. This method also includes the step of periodically transmitting a check in signal to a remote location to provide operating status, battery status or life, sensor parameter data signal strength, etc.

In yet another aspect, the invention is a discharge nozzle cap for a fire hydrant having a discharge outlet. The discharge nozzle cap includes a body having a first end and a second end. A bore extends from a first end into the body. Threads are formed adjacent the first end of the body for mounting the body on a fluid outlet of a fire hydrant. A housing is fixedly mountable in the bore in the discharge nozzle cap. A sensor is carried by the housing for detecting at least one operating parameter of a fire hydrant in which the housing is mounted. A transmitter is also carried in the housing. The transmitter, when receiving an output signal from the sensor, transmits a remote signal containing data corresponding to the sensor output.

The fire hydrant apparatus of the present invention provides numerous advantages over previously devised fire hydrant parameter detection and/or anti-tampering apparatus. By immediately detecting a tamper event, the water, fire, police departments or other emergency response personnel can be immediately notified to take corrective action. This conserves water since the hydrant is not unauthorizedly open for any lengthy period of time. Any attempts to steal water as well as the loss of system pressure due to a broken water main or open hydrant can also be detected and the location of the hydrant or broken water main immediately identified for quick response.

Additional benefits from the present invention include keeping the hydrants free of debris inserted by individuals which can render the fire hydrant inoperable for use during a fire. Any attempts to open the hydrant to insert hazardous materials into the water supply can also be immediately detected to minimize the range and spread of contamination.

Other benefits include the sensing of pressure changes in the water main by pressure increase detection. Such a pressure increase spike occurs in a section of a water main between two hydrants only when a line is shut down. Real time pressure sensing provided by the present apparatus will immediately reveal any pressure increase event occurring between hydrants indicating a possible deliberate forced introduction of contaminates through a service connection, such as a house or building.

BRIEF DESCRIPTION OF THE DRAWING

The various features, advantages and other uses of the present invention will become more apparent by referring to the following detailed description and drawing in which.

DETAILED DESCRIPTION

Figure 1:
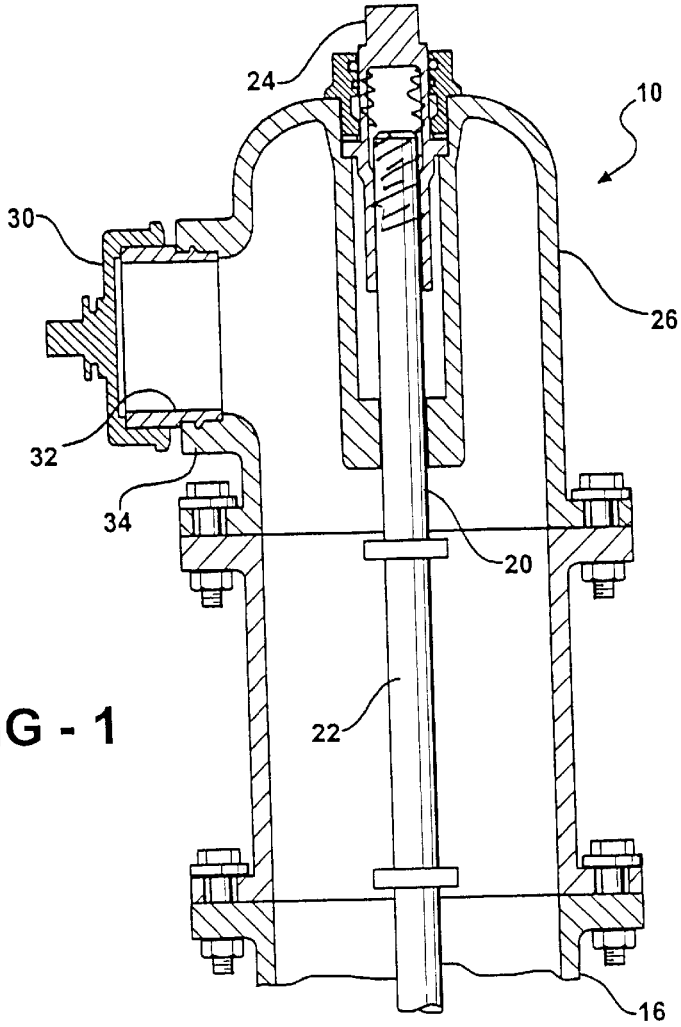
FIG. 1 is a cross-sectional view of a prior art fire hydrant.

Referring now to the drawing and to FIG. 1 in particular, by way of background there is depicted a typical fire hydrant 10, with which the present invention can be used since fire hydrants are constructed in a variety of different configurations, the fire hydrant 10 shown in FIGS. 1 and 13 will be described hereafter by way of example only.

Thus, by example, the fire hydrant 10, which is a model 6-BR fire hydrant manufactured by East Jordan Iron Works, Inc., East Jordan, Mich., includes a shoe assembly 232 having an inlet adapted to be fluidically coupled to a water supply main, not shown. A lower standpipe 16 is joined to an upper standpipe 14 which is in turn joined to a top bonnet assembly 26. A valve 230 is mounted in a seat in the shoe and is coupled by upper stem 20 and a lower stem 220 to a valve operating nut 24 mounted exteriorly on the upper bonnet assembly 26.

As is conventional, rotation of the valve operating nut 24 controls movement of the valve between open and closed positions to alternately allow the flow of water from the water main through the fire hydrant 10 or to block water flow from the water main to the fire hydrant 10.

At least one discharge nozzle cap 30, hereafter "cap" is threadingly coupled to a collar or nozzle 32 joined to and extending outward from an annular flange 34 on the bonnet 26. One or more caps 30, sleeves 32 and flanges 34 may be formed in a circumferentially spaced manner about the bonnet 26. Although not shown FIG. 1, a chain is typically connected between each cap 30 and the upper standpipe 14 to prevent loss of the cap 30 when the cap is unthreaded from the collar 32.

Figure 2:
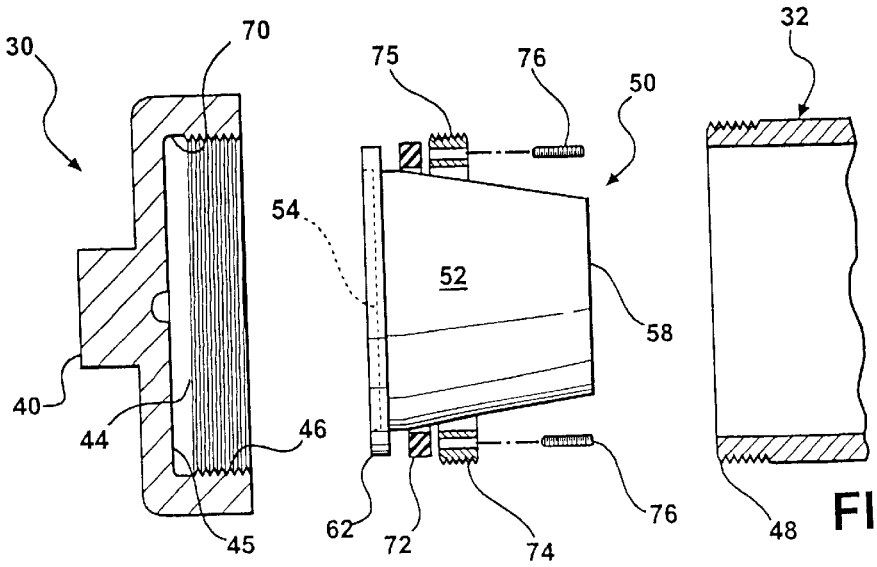
FIG. 2 is an exploded side elevational view of a tamper detection and signaling apparatus according to one aspect of the present invention shown in conjunction with the fire hydrant bonnet sleeve and threaded discharge nozzle cap.

As shown more clearly in FIG. 2, the cap 30 has an outer nut 40 which receives a wrench or tool to facilitate rotation of the cap 30 relative to the collar 32 to remove or attach the cap 30 to or from the collar 32. The cap 30 includes an open end 42, opposite from the end on which the nut 40 is attached. The open end 42 communicates with a hollow interior chamber or bore 44. Internal threads 46 extend into the chamber 44 inward from the open end 42 along the sidewall of the cap 30. The threads 46 threadingly mesh with corresponding threads 48 formed on an outer end of the collar 32. An annular seal washer is normally mounted at the end of the hollow chamber 44 in the cap 30 to engage the outer end of the collar 32.

The present invention uniquely provides an automatic tamper detection and signaling apparatus 50 which is mountable in the fire hydrant 10, typically inside of the cap 30. The tamper detection and signaling apparatus 50, hereafter referred to as the "detector" includes a closeable and sealable housing 52 having a cover 54 removably and sealingly attachable to one end of the housing 52.

The housing 52 can be formed of any suitable corrosion resistant material. Stainless steel, cast aluminum or various plastics, including composite plastics, may be employed to form the housing 52. The housing 52 extends from a first end 56 to an opposed second end 58. A sidewall 60 extending between the first and second ends 58 and 60 is provided with a generally decreasing taper extending towards the second end 58, by example only.

A radially outward extending flange 62, having an outer diameter greater than the outer diameter of the largest annular extent of the housing 52, is mounted on the first end 56 of the housing 52 by integral casting or formation with the housing 52. Preferably, the flange 62 is formed of metal.

Figure 3:
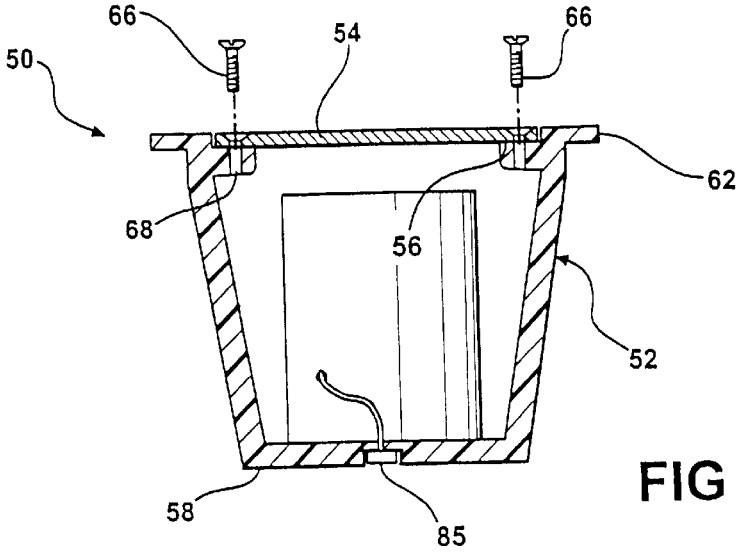
FIG. 3 is a side cross-sectional view through the housing of the tamper detecting signaling apparatus shown in FIG. 2.

The cover 54 is removably attachable to the first end 56 of the housing 52, typically by means of fasteners 66. The cover 54 may have a generally planar configuration or be provided with a hemispherical end portion extending from a peripheral flange joinable to a mating portion on the first end 54 of the housing 52. A seal member 68, such as an O-ring, is mounted in a recess in an enlargement on the first end 54 of the housing 52 and sealingly engages an inner surface of the cover 54 as shown in FIG. 3.

The housing 52 is sealingly mounted in the chamber 44 in the cap 30 with the flange 62 seated in an annular end portion 70 at the inner end of the bore 44 in the cap 30. An annular seal member or O-ring 72, which may be the same O-ring normally found in a conventional fire hydrant 10, is carried or mounted on an inner surface of the flange 62. A typically metallic annular retaining collar 74 having spaced circumferential apertures and external threads 75 is threaded with the threads 46 on the cap 30 into secure engagement with the seal 72 and the flange 62 on the housing 52 to removably mount the housing 52 to inside of the cap 30. One or more set screws 76 are insertable through the apertures in the retaining collar 74 the seal 50 into engagement with the flange 62 to maintain the housing 52 in non-rotatable position relative to the cap 30. This enables the housing 52 to rotate with rotation of the cap 30.

With housing 52 mounted inside the cap 30, in a manner described above, the cap 30 can be threaded onto the collar 32 by threading engagement of the threads 42 in the cap 30 with the external threads 48 on the collar 32 in a normal manner. Sealing between the collar 32 and the cap 30 is provided by the seal member 72.

The tamper detection and signaling circuit is mounted within the housing 52 typically on one or more circuit boards slidably mounted in the housing 52 through slots in the housing or otherwise fixed by means of stand-offs or fasteners to the inside surface of the housing 52 or the cover 54.

Figure 4:
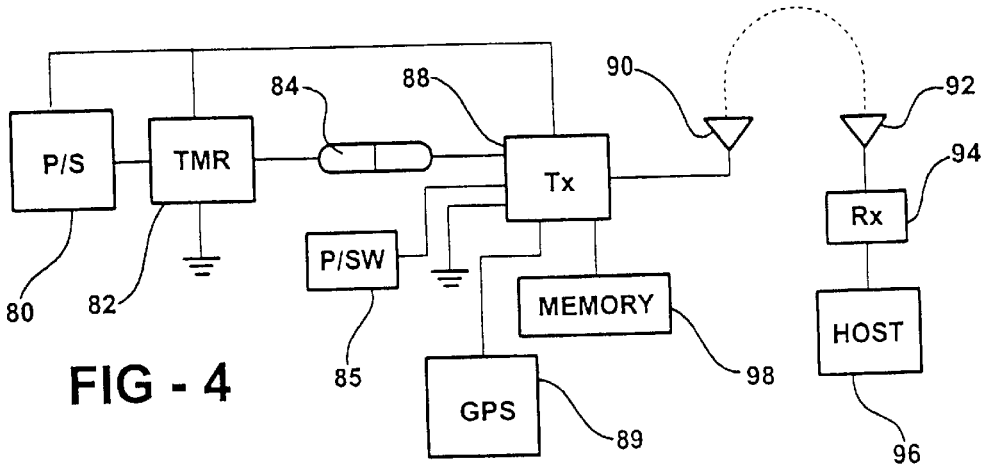
FIG. 4 is a block and schematic diagram of one aspect of a tamper detection and signaling circuit.

As shown in FIG. 4, the circuit includes a suitable power supply 80, such as one or more storage batteries. The power supply 80 provides electric power to a timer 82 which has a normally open switchable contact or switch. When power is applied to the timer 82 upon connection of the battery 80 to the circuit, the timer starts a pre-determined time period, at the conclusion of which the output contact is switched to a closed position thereby connecting electric power to a motion detector means, such as mercury switch 84. Other types of motion detectors, such as centrifugal-type detectors are also useable. The time period is sufficient to allow an installer to complete the insertion of the batteries to the circuit, the attachment of the cover 54 to the housing 52 and the threading attachment of the cap 30 to the collar 32. After the completion of the time period, any rotational movement of the cap 30 relative to the collar 32 will result in a closure of the motion detector switch 84 which provides an output 86 to a transmitter 88.

The transmitter 88 is a cellular, microwave or radio frequency transmitter capable of transmitting a suitable frequency signal through an antenna 90 which is mounted inside of the housing 52 remotely from the housing 52 in the fire hydrant 10. This signal represents a tamper or includes a data bit corresponding to which is received through a remote antenna 92 and a suitable signal receiver 94 at a host 96 which can be a central utility site, a police station, an emergency response network, etc.

The transmitter 88 may be provided with a activation signal power lock-up circuit to maintain the transmitter 88 in a continuously activated condition repetitiously sending remote signals after activation by the motion detector 84 or a pressure switch, described hereafter. The power lock-up circuit will continuously provide an input to the transmitter 88 enabling the transmitter 88 to continuously send remote signals for a predetermined time period, such as 30 or 60 seconds, by example only, even though the particular input signal, such as the output of the motion detector switch 84 or the output of the pressure switch described hereafter, has ceased or switched back to an open state.

The transmitter 88, in addition to transmitting a signal, when activation by closure of the motion detector switch 84, also transmits a fire hydrant identification code shown symbolically in FIG. 4 as being stored in a memory 98 coupled to the transmitter 88. This code can be a phone number or hydrant number specifically assigned to the particular housing 52 which can be cross indexed in a look-up table at the host 96 to the exact location of the fire hydrant 10 in which the housing 52 is mounted, a numeric code indicating the location of the fire hydrant 10, a GPS indication of the fire hydrant 10 also cross-indexible etc.

Although not shown in FIG. 4, the code stored in the memory 98 can be set prior to closure of the housing 52 by the cover 54 through a suitable dip switch accessible through the open end of the housing 52.

The stored signal can also be generated by an onboard GPS locator which, when activated by the timer 82 generates coordinate information of the fire hydrant 10 based on triangulation signals with GPS satellites. This GPS information, output from an onboard GPS 89, can be sent as part of the remote signal from the transmitter 88.

As shown in FIG. 3, the housing 52 may also provide a sealed mounting for a pressure switch 85 which is mounted in a shallow recess on the bottom 58 of the housing 52 and is coupled to a sealed opening in the bottom 58 to the circuit board mounted in the housing 52. The pressure switch 85 is capable of detecting pressure within the fire hydrant 10 when the cap 30 is mounted on the fire hydrant 10.

In use, after the tamper detection apparatus 50 of the present invention has been armed, as described hereafter, the pressure switch 85 is capable of detecting and generating an output signal upon sensing a predetermined pressure which would correspond to the waterline pressure of water disposed within the interior of the fire hydrant 10 if the valve 18 is subsequently moved to the open position. The output signal from the pressure switch 85 is input into the transmitter 88 to cause the transmitter 88 to generate the remote signal. The pressure switch output may also constitute a separate bit in the remote signal to signify a pressure detection condition as compared to a tamper detect signal from the motion detector switch 84.

The pressure switch output can be used as an indication that not only was the fire hydrant 10 tampered with, but the fire hydrant 10 was subsequently filled with water to indicate that harmful material may have been introduced through the open cap into the fire hydrant 10.

Figure 5:
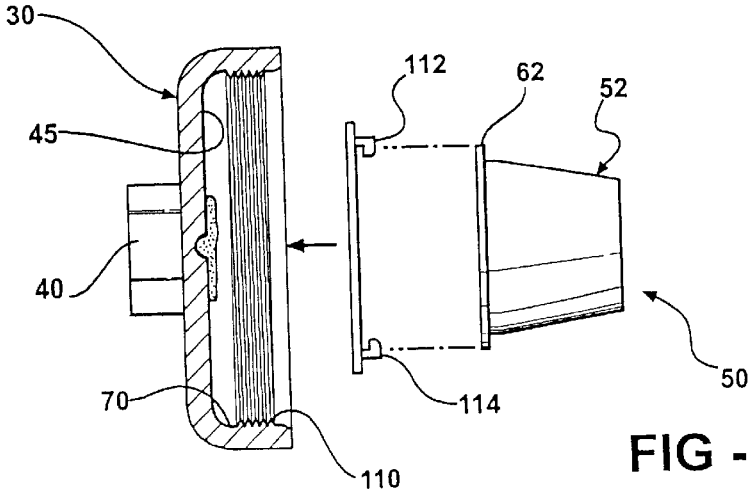
FIG. 5 is a side, cross-sectional view of an alternate housing discharge nozzle cap attachment.
Figure 6:
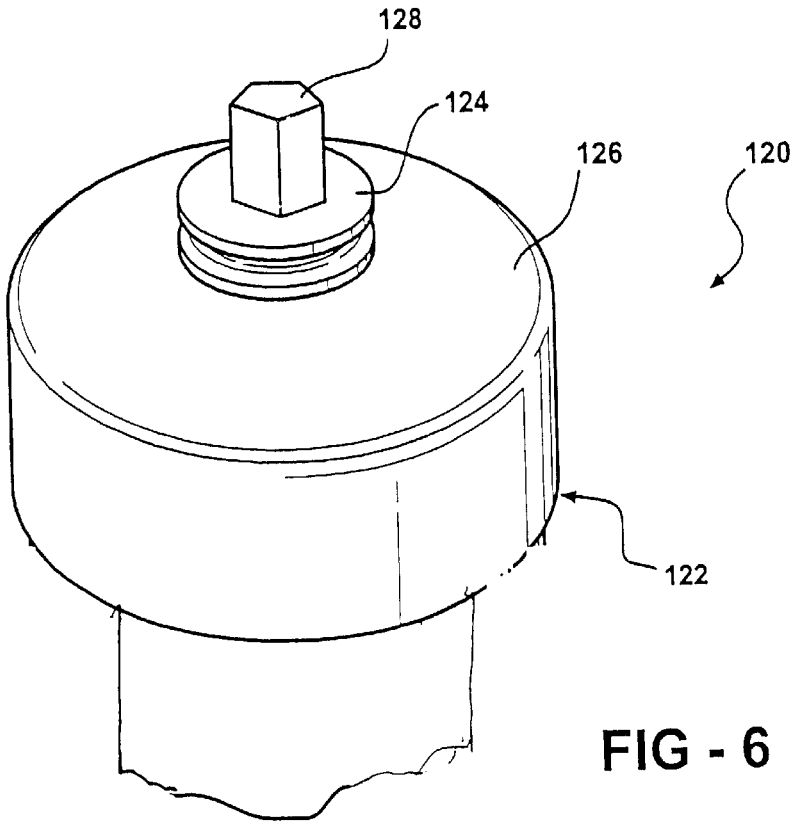
FIG. 6 is perspective view of another aspect of a tamper detection and signaling apparatus according to the present invention.

FIG. 5 depicts an alternate mounting of the housing 52 to the cap 30. In this aspect, a mounting plate 110 is provided with lock arms 112 and 114 which receive the flange 62 on the housing 52 in releasable engagement. The seal member or washer 72 is positioned between the cap 30 and the end of the collar 32.

The mounting plate 110 is fixed to the inside surface 52 at one end of the bore 44 in the cap 30 by means of a suitable adhesive, such as an epoxy adhesive by example only. Mechanical fasteners, such as screws, can also be employed to fixedly mount the plate 110 to the inside surface 45 of the bore in the cap 30. In mounting the housing 52 to the cap 30, the mounting plate 110 is first affixed to the cap 30. Next, the housing 52 is mounted in the plate 110.

In use, with the fire hydrant 10 in a valve closed position, one cap 30 is removed from a collar 32. The housing 52 is then fixedly mounted inside of the cap 30 by either of the mounting methods described above. It will be understood that the particular fire hydrant I.D. has been set prior to mounting the housing 52 to the cap 30.

Once the battery 80 has been mounted inside of the housing 52 to activate the timer 82, the cover 54 is then attached to the housing 52 and the housing 52 mounted in the cap 30. The time period established by the timer 82 will be sufficient to allow for the normal amount of time to accomplish these steps as well as the subsequent threading attachment of the cap 30 to the collar 32. Once the time period established by the timer 82 has expired, electric power is supplied to the motion detector switch 84 thereby "arming" the switch 84 to detect any further motion of the cap 30 relative to the collar 32 which will be a tamper event. Any such motion will cause closure of the motion detector switch 84 thereby activating the transmitter 88 to send the tamper detect and fire hydrant I.D. signal to the remote host 96.

The present tamper detection and signaling apparatus is also usable with fire hydrants having multiple caps. One approach would be to employ separate housings 52 in each cap 30, each housing 52 containing a distinct tamper detection and signaling circuit, but all programmed with the same fire hydrant location I.D. Alternately, a single primary housing 52 with the tamper detection and signaling circuit described above mounted therein, can be mounted in one cap. Similar secondary tamper detection and signaling circuits mounted in identical housings can also be mounted in all of the other caps on the same hydrant. However, such other housings can be provided with a lower power transmitter capable of sending a signal indicating a tamper event associated with each particular cap to the first housing which has a receiver capable of receiving the transmitted signals from the secondary circuits. The receiver activates the transmitter 88 to send the remote tamper detection and fire hydrant I.D. signal.

Referring now to FIGS. 6–11, there is depicted another aspect of a tamper detection and signaling apparatus 120 according to the present invention. The apparatus 120 includes a hose nozzle cap 122 which is threadingly and sealingly engagable with the collar 32 on a fire hydrant, such as the fire hydrant 10 shown in FIG. 1. The cap 122 is formed of a high-strength, moldable material, such as fiberglass, glass fiber filled nylon, etc.

The cap 122 has a generally cylindrical shape with a raised flange 124 projecting from an upper end 126. A conventionally formed shutoff nut 128 extends from the flange 124 for receiving a removal tool, such as a wrench, to remove the cap 120 from the fire hydrant 10 to allow connection of a hose to the hose collar.

Figure 7:
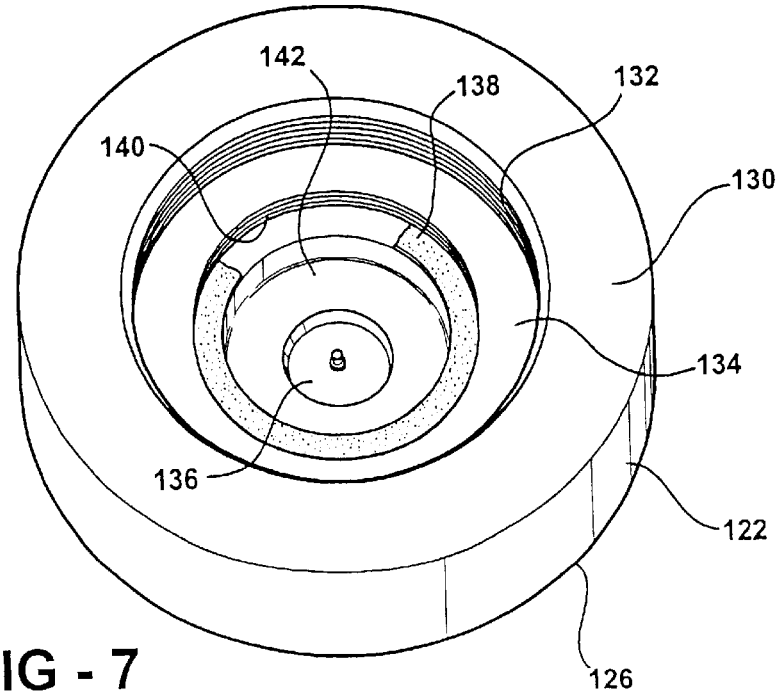
FIG. 7 is a perspective view showing the interior of the threaded discharge nozzle cap depicted in FIG. 6.

As shown in FIG. 7, the interior of the cap 122 has a stepped bore extending from an end 130 opposite from the end 126. The stepped bore includes a threaded end portion 132 which is configured for meshing engagement with the external threads on the collar 32 extending outward from the flange 34 on the bonnet 26 of the fire hydrant 10 as shown in FIG. 1 to provide attachment of the cap 122 to the collar 32.

Figure 9:
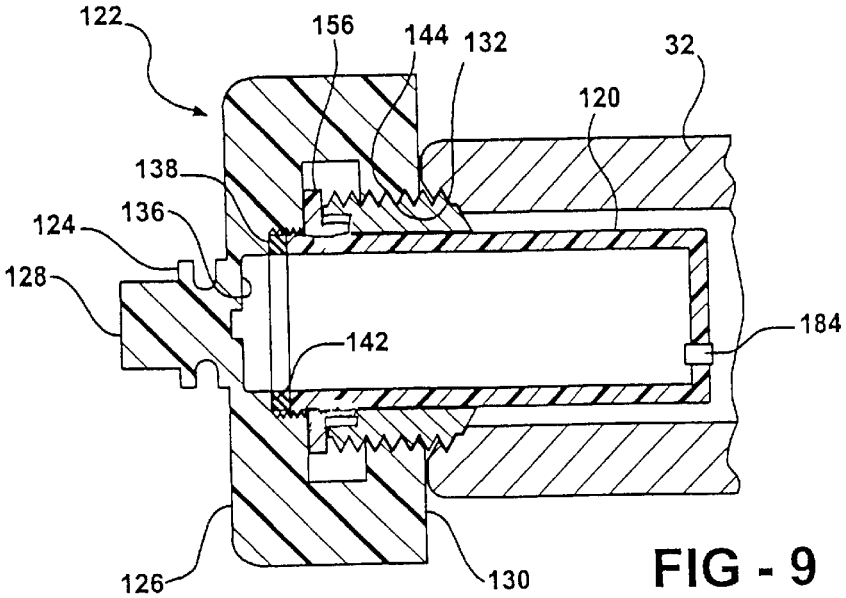
FIG. 9 is a longitudinal cross-sectional view showing the discharge nozzle cap and housing of the present apparatus mounted on a discharge outlet sleeve of a fire hydrant.

The threaded end portion 132 of the bore ends at an expanded portion seen in FIG. 9 which ends in a shoulder 134. The shoulder 134 forms a seat for a seal member, such as a rubber or elastomeric flat seal 138. The seal 138 provides a water tight connection for the housing 121 to the cap 122.

A smaller diameter bore 140 extends axially inward from the shoulder 134 to a smaller diameter shoulder 142 which includes a recess 136. The bore 140 is threaded to receive threads 144 on one end of a housing 150 to enable attachment of the housing 150 to the cap 122.

Figure 8:
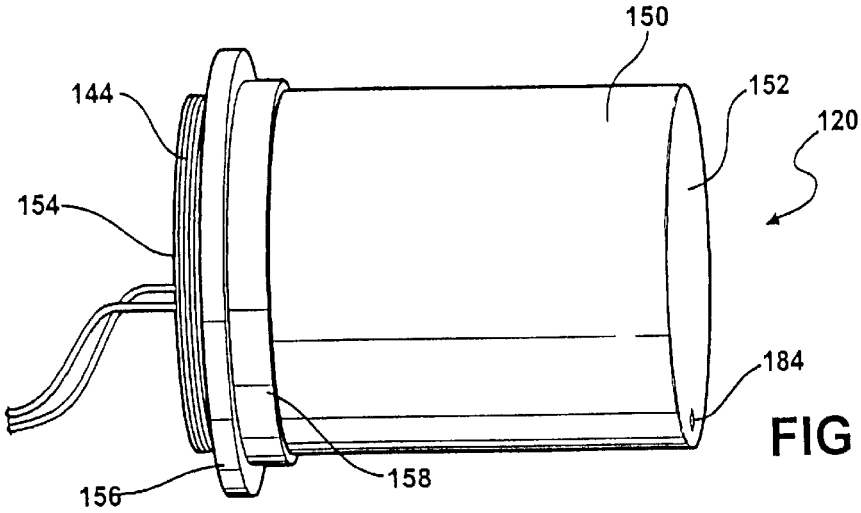
FIG. 8 is a perspective view of the housing shown in FIG. 6.
Figure 10:
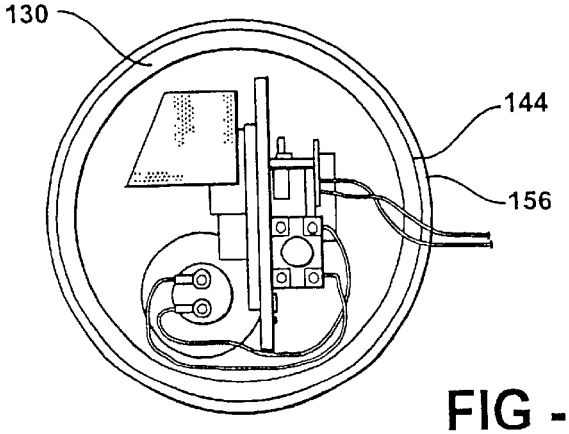
FIG. 10 is a plan view of the control apparatus mounted in the housing shown in FIG. 8.

As shown in FIGS. 8–10, the housing 150 includes a generally cylindrical body formed of a suitable environmental and water resistant material, such as a composite plastic, including fiberglass, fiberglass filled nylon, etc. The housing 150 extends from a first end 152 to an opposed second end 154 on which the threads 144 are mounted. A radially stepped collar 156 formed of a resilient, sealing material is mounted on the housing 150 adjacent to the threads 144. A radially small end extends over the housing 150. The collar 156 carries a seal means which can be a discrete seal element which is engagable with the seal 138 in the cap 122 or a resilient coating over the flange 156 and an adjacent portion 158 of the housing 150.

In use, the housing 150 is threaded via the threads 144 into the threads 140 in the cap 122 until the seal member 156 engages the shoulder 134 in the cap 122. At the same time, the second end 154 of the housing 150 engages the seal 138. This sealingly closes the interior of the housing 150 from the fluid environment found in a typical fire hydrant 10.

Figure 11:
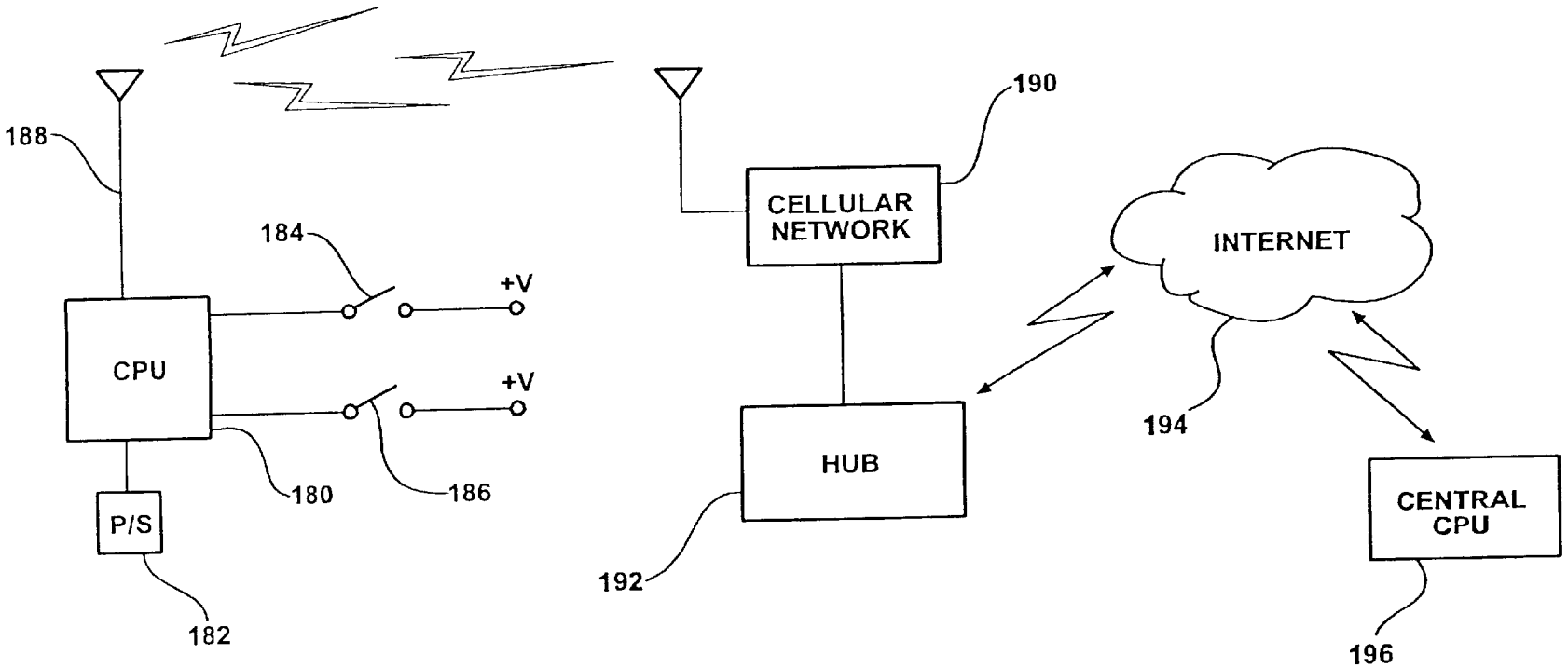
FIG. 11 is a block diagram of the control apparatus for the aspect of the invention shown in FIGS. 6–10.

Referring now to FIGS. 10 and 11, there is depicted the control means mounted in the housing 150 of each fire hydrant 10, for example, in a particular area, such as a neighborhood, an entire city, etc.

In each housing 150, a central processing unit 180, such as a CMM8700 Cellular Modem Module using MicroBurst Technology via the Aeris.net wireless system is mounted on a circuit board fixed within the housing 120. The CMM8700 is available from Standard Communications, in Carlsbad, Calif. The CPU 180 is a stand alone, microprocessor based telemetry device which transmits short data bursts. The CPU 180 communicates with firmware in an onboard memory, not shown, which is programmed with MicroBurst-specific software.

A power supply 182, such as a one or more batteries is also mounted within the housing 121 to supply power to the CPU 180 as well as a pressure sensor or transducer 184 and a tamper or motion switch 186. The pressure sensor 184, depicted as mounted in the bottom of the housing 120 as shown in FIG. 11, provides an analog signal proportional to the sensed water pressure within the fire hydrant 10. The pressure transducer or sensor 184 is normally inactive and turns "on" only when water pressure contacts the sensor. This turns the pressure transducer 184 "on" which generates an input signal to the CPU 180. This signal is an analog signal proportional to the actual water pressure in the hydrant 10 in pounds per square inch. The CPU 180, acting under control of the firmware, then transmits a signal via an onboard antenna 188 contained within the housing 121 to the nearest cellular network tower 190 along the control channels of the SS-7 cellular network.

In addition to the analog output signal from the pressure sensor 184, the pressure sensor 184 can be of the type that is preset to a minimum threshold pressure and, when detecting the minimum threshold pressure, sends an output signal to the CPU 180. The preset threshold pressure can be variably set.

The motion or tamper detection switch 186 is a mercury motion detector switch mounted on the circuit board within the housing 121. The switch 186 detects angular rotation or tilt of the cap 122 after an initial settling down period and is unique in that, when it is undisturbed in any position, provides an open circuit output and does not require that the cap 122 be positioned in any specific axis point, such as twelve o'clock, three o'clock, etc. A typical motion detect switch 186 which can be advantageously employed in the present invention is available from Signal Systems International.

Referring again to FIG. 12, once a signal from a particular CPU 180 is received from the cellular network 190 by the cellular network hub 192, the data contained within the signal is re-transmitted in TCP/IP protocol via the Internet 194 to central CPU 196, located, for example, in a water treatment plant system control and data acquisition control room. The CPU 196 downloads the data and provides suitable notifications, alarms, reports. The signals transmitted from the hub 192 to the central CPU 196 can be in the form of electronic mail messages.

The central CPU 196 or messages from the Internet itself 194 may be directed to other municipality departments or individuals, including emergency response personnel such as police, water or fire departments 200, via e-mail notification in key individual's computers 201 or an e-mail alert via IP addressable devices, such as pagers, cell phones.

Each CPU 180 also receives an acknowledgment message from the host receiver 196 that an alert has been received. The CPU 180 can also receive commands to change parameters, such as "check-in" times, etc.

Due to the large number of apparatuses 120 which may be used by particular water departments, each reporting to the one central CPU 196, distinct addresses must be supplied to each CPU 180. Each CPU 180 will be provided with a unique, distinct M.I.N. (mobile identification number). The M.I.N. is stored in memory coupled to the CPU 180 and transmitted as data in each signal from the CPU 180 to the central CPU 196.

During initial installation of the apparatus 120 on a fire hydrant 10, a handheld data programmer can be used to scan a barcode placed on a label on each cap 122 to record the M.I.N. of the CPU 180. Data is also entered into the programmer for the address and/or GPS coordinates of the hydrant 10 on which the particular apparatus 120 is mounted.

This data is delivered to the central CPU 196 and stored in a look-up table such that upon receiving a M.I.N. in a data message from a hydrant 10, the central CPU 196 can immediately determine the exact location of the fire hydrant 10 associated with the received message.

Alternately, instead of or in addition to the M.I.N., each apparatus 120 may be provided with a GPS transceiver which, when activated by an output of one of the sensors, accesses the GPS satellite network to determine its position in latitude and longitude. This geographic coordinate data can be supplied as part of the remote signal transmitted to the central location for processing to determine the specific location of the particular fire hydrant 10, in terms of street location, street address, etc. It is also feasible, within the scope of the present invention, to predetermine the geographic coordinate position of each apparatus 120 at the time of installation of each apparatus 120 in a fire hydrant 10. This can be done by a separate GPS transceiver thereby eliminating the need for mounting the GPS transceiver within the housing of the apparatus 120.

Other sensors may also be mounted in the housing 121 and connected as inputs to the CPU 180 of each device 120 for monitoring other parameters associated with a particular fire hydrant 10. For example, temperature sensors 197 for both water flowing through the fire hydrant 10 and the ambient air can be provided. Another type of sensor is a Ph sensor 198 and can be used to detect the acid/base level of a water sample from a particular fire hydrant 10. A condensation or water sensor 199 may be mounted within the housing of each apparatus 120 to detect water or condensation within the interior of the housing which could render the apparatus 120 inoperative.

Another feature built into the firmware of each CPU 180 is an automatic "check-in" feature that causes each CPU 180 to transmit a signal to the central CPU 196 at a particular time, such as once during each twenty-four hour day, or, by example, once every hour or twenty-four times a day. The timing of "checkin" signals from each CPU 180 in a particular area can be staggered so that the signals transmitted to the central CPU 196 do not overlap. However, the high speed cellular network is capable of handling multiple signals at the same time from multiple CPUs 180.

The "check-in" feature can be used to determine if the fire hydrant 10 is tampered with, other than by removal of the cap 120 which will be detected by the motion sensor 186 as described above. For example, if the cap 120 is covered with metallic foil or some other shielding or jamming device, the CPU 180 will not be able to transmit or receive data. Thus, the lack of a "check-in" signal from a particular CPU 180 at the required "check-in" time, will alert the central facility that a particular CPU 180 has been disabled or is non-functioning thereby enabling immediate dispatch of emergency response and/or maintenance personnel for physical inspection and/or testing of the affected CPU 180.

Figure 12:
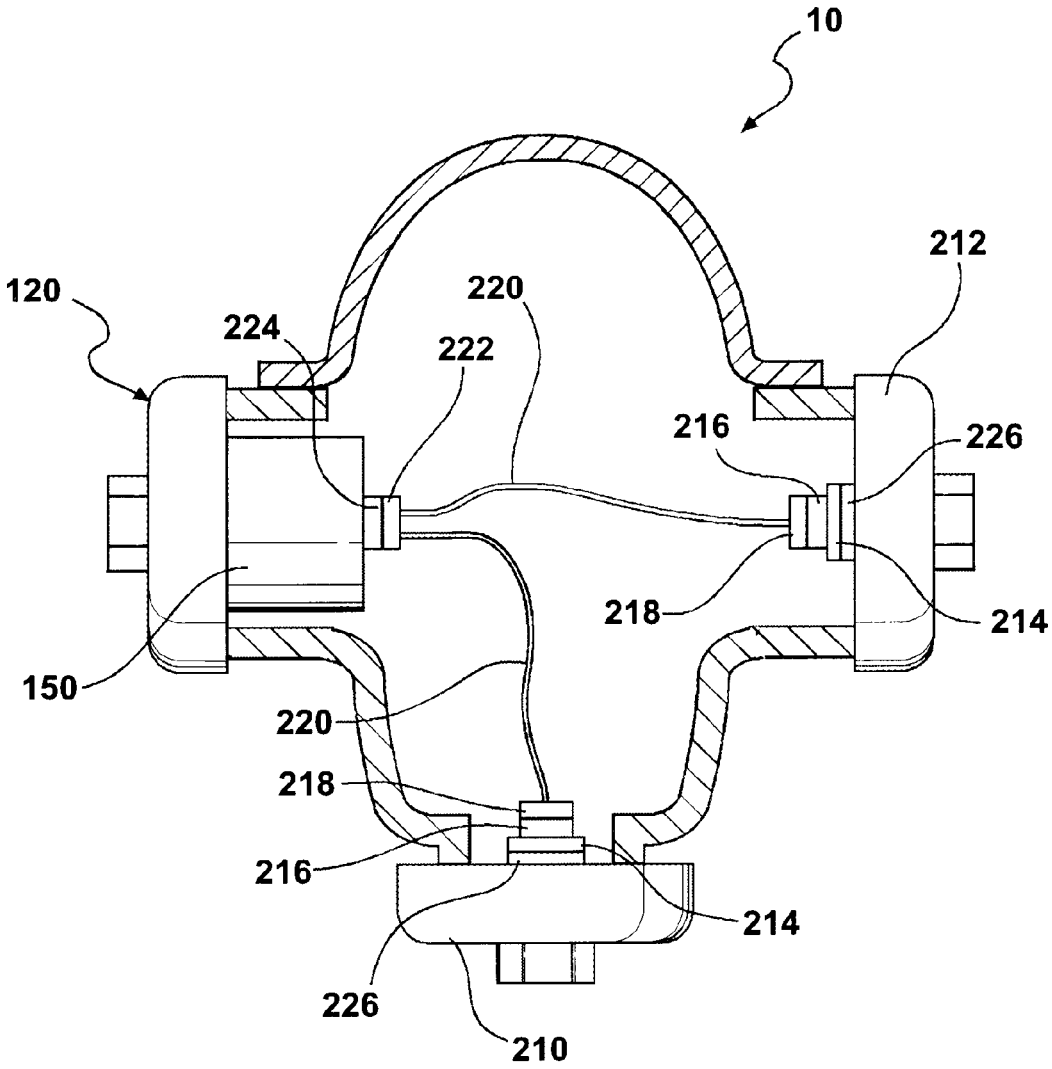
FIG. 12 is a pictorial representation of an alternate aspect of the present invention shown in use with a fire hydrant having auxiliary discharge outlet caps.

Referring now to FIG. 12, there is depicted another aspect of the present invention wherein the apparatus 120 can be employed on fire hydrants having multiple or auxiliary discharge outlets including discharge outlets closed by rotatable nozzle caps 210 and 212. Although identical apparatus 120 can be mounted on each auxiliary cap 210 and 212, economic advantage can be obtained by coupling each auxiliary cap 210 and 212 to a motion detection means which are in turn coupled to the apparatus 120. For example, a motion detector 214, such as that describe above, is mounted in a water proof housing. A two part connector formed of a first connector part 216 fixed to the housing 214 of the motion detector mates with a second connector part 218 fixedly mounted on one end of a cable or harness 220. A harness assembly 220 can be covered by a waterproof outer sheath. Each harness assembly 220 extending from connections to the motion detectors 214 associated with the auxiliary caps 210 and 212 are connected to one or more connectors formed of a first connector part 222 attached to the ends of the harnesses 220 and a second connector part 224 fixedly mounted on the bottom of the housing 150. The conductors extending through the connector 222 and 224 pass to the interior control in the housing 150 and are connected as parallel inputs along with the motion detector mounted within the housing 150. Each auxiliary motion detector 214 is mounted to the associated auxiliary caps 210 and 212 in a releasable manner. For example, a magnet 226 can be fixed to the housing of the motion detector 214 for releasable attachment to the interior surface of the existing metal cap 210 or 212. In this manner, rotation of any of one of the caps 201 and 212 causes immediate activation of the associated motion detector 214. The activated motion detector 214 then sends a signal through the harness 220 to the control in the main housing 150 which activates the control to transmit a signal to a remote location identifying the particular fire hydrant 10.

Each motion detector 214 can be connected to the auxiliary caps 210 and 121 prior to mounting of the apparatus 120 to the fire hydrant 10. Similarly, in the event of an actual fire requiring removal of the caps 210 or 212, a fireman can remove the cap 210 or 212 and, as the cap 210 or 212 is being pulled away from the fire hydrant 10, the connector parts 218 and 216 will release. The fireman can reach inside the hydrant to remove all of the harnesses 220 from the housing 150 to prevent interference with the free flow of water through the hydrant and the opened discharge outlets.

Figure 13:
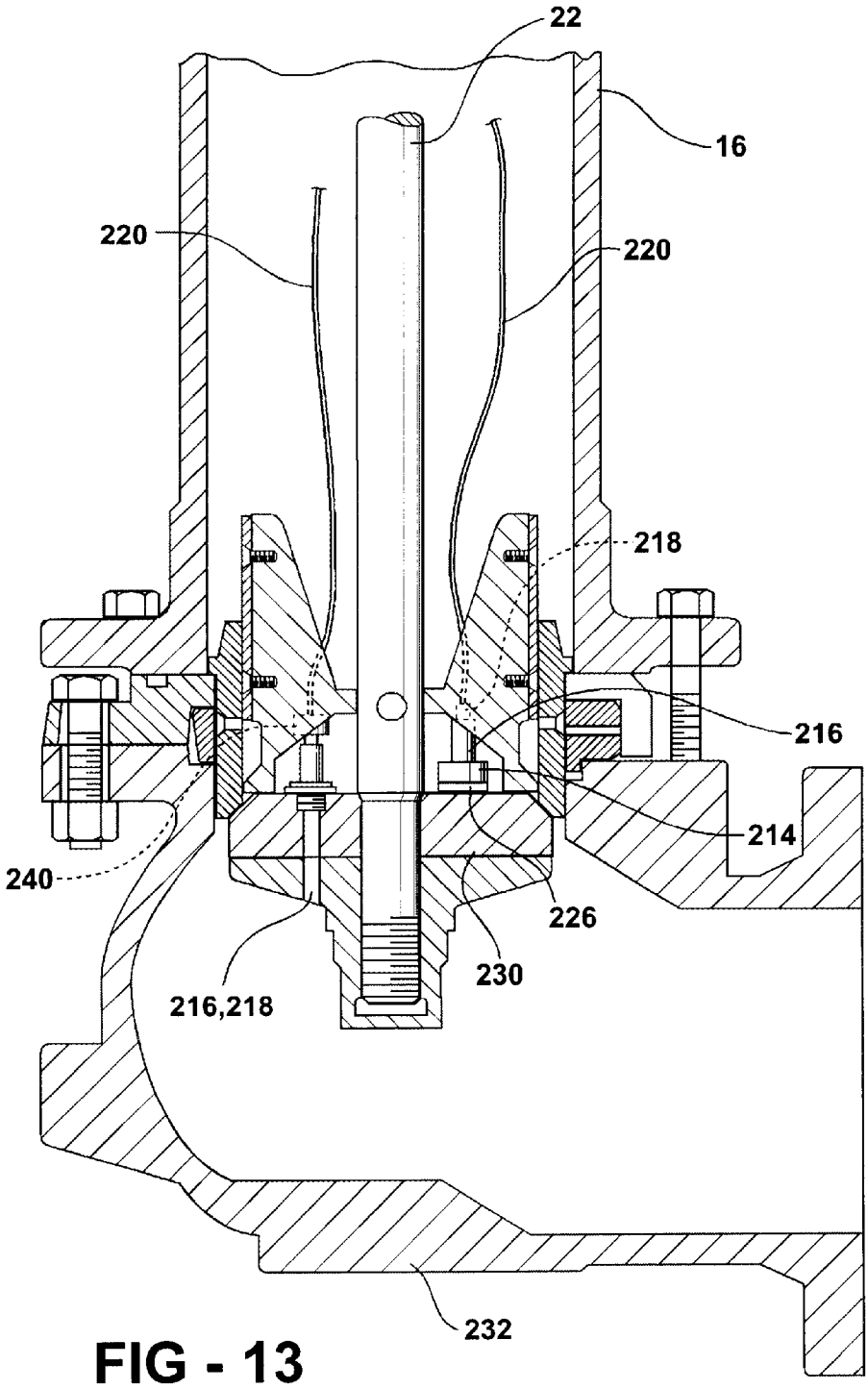
FIG. 13 is a cross-sectional view showing another aspect of the present invention used with a lower valve of a fire hydrant.

As shown in FIG. 13, another use of the motion detector 14 shown in FIG. 12 is with the lower valve 230 of a fire hydrant 10. Such a valve 230 is fixed to the lower stem 22 extending through the lower standpipe 16 of the fire hydrant 10. The lower standpipe 16 is secured by fasteners to a shoe assembly 232 which provides a connection to a water distribution conduit, water main, etc. A motion detector 214 in a sealed housing can be releasably fixed to the lower valve 230 by means of a magnet 226 as described above. Two-part connectors 216 and 218 are provided on the motion detector housing and a harness 220. The other end of the harness 220 terminates in a mating connector 222 which plugs into a connector 224 affixed to the housing 150 of the apparatus 120 in the same manner as the additional auxiliary nozzle cap harnesses shown in FIG. 12 and described above.

In use, any up or down movement of the lower valve 230 will cause the motion detector 214 to generate a signal which is transmitted by the harness 220 to the housing 150. This signal is connected in parallel with the other motion detector inputs to the control means in the housing 150 and causes the control means to generate and transmit a signal to a remote location identifying the particular fire hydrant where its lower valve 230 has been moved.

In addition, a second pressure transducer or switch 240 can be mounted, for example, by threading, to an inside surface of the lower valve 230. The same wiring harness 220 and connector assembly 216 and 218 can be used to connect the switch 240 on lower valve 230 to the housing 150 in the bonnet 26 of the fire hydrant 10.

The sensing end of the pressure transducer 240 sits in a bore extending through the valve 230 and extending out of the shoe assembly 236 and valve 230 and into the water supply main. This enables the pressure transducer 240 to read the water pressure in the main, either continuously or when polled by the control means in the housing 150. A high or low pressure threshold can be variably set for the pressure transducer 240 to generate an output.

This location of a pressure transducer or switch 240 within the portion of the fire hydrant 10 exposed to the pressure of the water main acts as a point pressure means to enable the water department to determine the water pressure in the main at the location of each fire hydrant 10.

The use of the pressure sensor 240 has an additional advantage in that it can sense a pressure increase caused by a forced introduction at a higher pressure than the nominal water pressure within the water main from an exterior source, such as a point of access to the water system, i.e., a faucet, a hot water tank, etc., in a house or building, between two fire hydrants. This pressure increase can be detected by the pressure sensors 240 in two adjacent fire hydrants 10 on either side of the forced entry point to enable the water department to immediately determine the area of the pressure increase. Since such a pressure increase results from the forced introduction of material into the water system which could cause contamination of the water supply, the present pressure sensor and transmitter uniquely provide a detection of such forced entry which has not been previously available to a municipal water department.

In summary, there has been disclosed a unique fire hydrant anti-tamper detection apparatus which can be easily mounted on existing fire hydrants to send a signal to a central facility that a particular fire hydrant has been tampered with by unauthorized removal of the fire hydrant discharge nozzle cap. The apparatus of the present invention also uniquely includes a pressure sensor which can also be used to activate the apparatus to send a signal to the remotely located central facility to indicate that water is flowing through the fire hydrant. Main water pressure data sampling can also be obtained without requiring a utility person traveling to each hydrant location and apply sensor equipment to collect such pressure data. The present apparatus also conserves water by minimizing the amount of time that a fire hydrant may be unauthorizedly open for water flow. In addition, unique sensing of removal of the nozzle cap can minimize the possibility of vandalism of the fire hydrant by insertion of debris which normally renders the fire hydrant unusable in the event of fire or can cause damage to fire fighting equipment by blocking hoses, engine pumps, etc.

What is claimed is:

1. A tamper detection apparatus for a fire hydrant having a discharge nozzle, the apparatus comprising:

a cap mountable on a discharge nozzle of a fire hydrant;

a cap movement detector mounted to a fire hydrant discharge nozzle cap, the cap movement detector generating an output upon detecting removal movement of the cap relative to the fire hydrant; and transmitter means, mounted to a fire hydrant cap and responsive to an output of the cap movement detector, for transmitting a tamper detection signal remotely from the fire hydrant.

2. The apparatus of claim 1 wherein the detector and the transmitter means are carried in a housing fixedly mountable in the fire hydrant cap.

3. The apparatus of claim 2 further comprising:

seal means for sealing the housing to the fire hydrant cap.

4. The apparatus of claim 3 wherein the housing carries a removable sealable cover allowing access to an interior of the housing.

5. The apparatus of claim 4 further comprising:

fasteners for joining the cover to the housing.

6. The apparatus of claim 4 further comprising:

a seal interposed between the cover and the housing.

7. The apparatus of claim 2 wherein the housing is adapted to be fixedly mounted to the fire hydrant cap.

8. The apparatus of claim 7 further comprising:

a seal for sealing the housing to the fire hydrant cap.

9. The apparatus of claim 7 wherein:

the cap is attachable to the fire hydrant;

the apparatus further including a rotatable collar to mount the housing to the cap.

10. The apparatus of claim 9 further comprising:

fasteners extendable through the rotatable collar in the housing into engagement with the cap to non-rotatably fix the housing to the cap.

11. The apparatus of claim 7 further comprising:

a plate adapted to be fixedly mounted on the cap, the housing mountable to the plate.

12. The apparatus of claim 11 wherein:

the housing is removably mountable in the plate.

13. The apparatus of claim 1 wherein the cap movement detector comprises:

a motion detection switch mounted for movement with movement of the cap and providing an output signal when subject to movement.

14. The apparatus of claim 13 further comprising:

a stored fire hydrant location identification, the transmitter means transmitting the fire hydrant identification when transmitting the tamper signal.

15. The apparatus of claim 1 further comprising:

pressure sensor means, mounted on the housing, for detecting fluid pressure within a fire hydrant.

16. The apparatus of claim 1 further comprising:

a seal member mountable in the cap; and a housing carrying the transmitter means, the housing having a surface sealingly engageable with the seal member when the housing is mounted in the cap.

17. The apparatus of claim 1 further comprising:

means, carried with the transmitter, for providing the geographic coordinate location of the fire hydrant in which the transmitter means is mounted.

18. The apparatus of claim 17 wherein:

the transmitter means transmits the geographic coordinate location information when transmitting the tamper detection signal.

19. A tamper detection apparatus for a fire hydrant having a discharge nozzle, the apparatus comprising:

a discharge nozzle cap mountable on a discharge nozzle of a fire hydrant;

a discharge nozzle cap movement detector mounted to the discharge nozzle cap to detect movement of the cap relative to the fire hydrant;

a transmitter, responsive to an output of the detector, for transmitting a tamper signal remotely from the fire hydrant;

a housing, the detector and the transmitter carried in the housing, the housing mounted in the fire hydrant cap; and a stored fire hydrant location identification, the transmitter transmitting the fire hydrant identification when transmitting the tamper signal.

20. The apparatus of claim 19 wherein the housing fixedly mounted to the cap.

21. The apparatus of claim 20 further comprising:

a seal for sealing the housing to the cap.

22. The apparatus of claim 19 further comprising:

the cap is attachable to a fire hydrant;

the apparatus further including a rotatable collar to mount the housing to the fire hydrant cap.

23. The apparatus of claim 19 wherein the cap movement detector comprises:

a motion detection switch providing an output signal upon detecting motion.

24. The apparatus of claim 19 further comprising:

pressure sensor means, mounted on the housing, for detecting fluid pressure within a fire hydrant.

25. The apparatus of claim 19 further comprising:

a seal member mountable in the cap; and a housing carrying the transmitter, the housing having a surface portion sealingly engageable with the seal member when the housing is mounted in the cap.

26. The apparatus of claim 19 further comprising:

means, carried with the transmitter, for providing the geographic coordinate location of the fire hydrant in which the transmitter means is mounted.

27. The apparatus of claim 26 wherein:

the transmitter means transmits the geographic coordinate location information when transmitting the tamper detection signal.

28. A fire hydrant comprising:

a housing fluidically connected to a water supply conduit;

a discharge outlet carried in the housing;

a cap threadingly mountable over the discharge outlet to removably close the discharge outlet;

a cap movement detector coupled to the fire hydrant cap to detect movement of the cap relative to the fire hydrant; and a transmitter, coupled to the cap and responsive to an output of the cap movement detector, for transmitting a tamper detection signal remotely from the fire hydrant.

29. The apparatus of claim 28 further comprising:

a pressure sensor coupled to the cap for detecting a predetermined water pressure within the fire hydrant; and the transmitter, coupled to the cap and responsive to an output of the pressure sensor, for remotely transmitting a pressure signal.

30. A method of detecting tampering with a fire hydrant having a discharge outlet comprising the steps of:

providing a discharge outlet cap for a discharge outlet;

coupling a discharge outlet cap movement detector to the cap to detect movement of the cap relative to the housing; and coupling a signal transmitter to the detector wherein the transmitter, in response to an output from the detector, transmits a tamper signal remotely from the fire hydrant.

31. A method of monitoring a parameter of a fire hydrant having a discharge outlet and a valve opening the fire hydrant to water flow, the method comprising the steps of:

coupling a parameter sensor to at least one of a discharge outlet cap and a valve to detect an operating parameter of the fire hydrant; and coupling a signal transmitter to the parameter sensor wherein the transmitter, in response to an output from the parameter sensor, remotely transmits a data signal corresponding to the sensed operating parameter from the fire hydrant.

32. The method of claim 31 wherein the step of coupling a parameter sensor comprises the step of:

coupling a pressure sensor to the valve in a position to detect pressure of the water supply side of the water supply conduit fluidically coupled to the fire hydrant when the fire hydrant valve is in any position.

33. A cap for a fire hydrant having a fluid discharge outlet, the cap comprising:

a body having a first end and a second end, a bore extending from the first end into the body;

threads formed adjacent the first end of the body adapted for engagement with a fluid outlet of a fire hydrant;

a housing fixedly mountable in the bore in the cap;

a sensor, carried by the housing, for detecting at least one operating parameter of a fire hydrant in which the housing is mounted; and a transmitter carried in the housing, the transmitter, when receiving an output from the sensor, transmitting a remote signal containing data corresponding to the sensor output.

34. The method of claim 33 further comprising the step of:

transmitting the signal from the transmitter to emergency response personnel.

35. The apparatus of claim 33 further comprising:

threads formed in the bore of the cap body; and the housing having a threaded end threadingly engageable with the threads in the bore of the cap body.

36. The apparatus of claim 33 further comprising:

a shoulder formed in the bore in the housing; and seal means, mountable on the shoulder, and engageable by the housing, for sealing the housing to the cap body.

37. The apparatus of claim 33 wherein:

the cap is formed of a non-metallic material.

38. The apparatus of claim 33 wherein:

the housing is formed of a non-metallic material.

39. A method of detecting an operating parameter of a fire hydrant having a discharge outlet, the method comprising the steps of:

providing a cap for the discharge outlet;

storing a unique fire hydrant identification in a housing mountable within the cap;

storing the geographical coordinates of the fire hydrant along with the unique fire hydrant identification; and providing a transmitter in the housing for transmitting a signal from the housing in the fire hydrant to a remote processor, the signal containing at least the fire hydrant identification.

40. The method of claim 39 further comprising the steps of:

periodically transmitting a check-in signal to a remote location.

* * * * *